United States Patent [19]

Kocher

[11] Patent Number: 4,619,297

[45] Date of Patent: Oct. 28, 1986

[54] REFILLABLE PRESSURE SPRAY CONTAINER

[76] Inventor: Kenneth E. Kocher, 6030 Glenmont, Apt. 10, Houston, Tex. 77081

[21] Appl. No.: 686,004

[22] Filed: Dec. 24, 1984

[51] Int. Cl.[4] ..... B65B 31/00

[52] U.S. Cl. ..... 141/20; 222/3

[58] Field of Search ..... 141/3, 4, 20, 349; 251/149.7; 222/3

[56] References Cited

U.S. PATENT DOCUMENTS

| | | | |
|---|---|---|---|
| 2,645,907 | 7/1953 | Droste et al. | 141/4 X |
| 2,671,590 | 3/1954 | McBean et al. | 141/3 |
| 3,361,406 | 1/1968 | Cruse | 251/149.7 |
| 3,473,704 | 10/1969 | O'Donnell | 141/20 X |

*Primary Examiner*—Stephen Marcus
*Assistant Examiner*—Mark Thronson
*Attorney, Agent, or Firm*—Neal J. Mosely

[57] ABSTRACT

A refillable pressure spray container comprises a container having a filling and dispensing nozzle extending outwardly from a cap secured thereon, the nozzle being received in a quick disconnect coupling attached to a motor-driven pump. The quick disconnect coupling has a valve actuating member to raise a valve plunger in the nozzle when inserted into the coupling to establish communication between the pump and the interior of the container. The motor pumps air or gas under pressure into the container. At a predetermined container pressure, a relief valve deactivates the pump. When the container nozzle is removed from the coupling, the plunger closes communication between the container and the pump to pressure seal the contents within the container. A conventional spray nozzle is attached to the plunger for using the refillable container as a conventional aerosol container.

20 Claims, 9 Drawing Figures

REFILLABLE PRESSURE SPRAY CONTAINER

BACKGROUND OF THE INVENTION

1. Field of the Invention

This invention relates to pressure-operated spray devices, and more particularly to a pressure-operated spray container having improved means for refilling or recharging the container for repeated use.

2. Brief Description of the Prior Art

There are several patents which illustrate the art of refillable pressure-operated spray containers.

Scheck, U.S. Pat. No. 2,841,190 discloses a refillable spray device and recharging means therefor comprising a container having a dish-shaped cap with a dispensing valve assembly supported thereon. Recharging of the device is effected directly through the valve that is ordinarily used to discharge the container contents. The refilling means is designed to hold the valve in the open position while maintaining a seal thereabout, concurrently with the filling operation, with the valve automatically moving to a closed position responsive to removal of the refilling means.

Chamberlin, U.S. Pat. No. 3,592,244 discloses a flask charging apparatus which includes a compressor driven by an electric motor, the operation of the motor being initiated by a switch engaged by the flask when mounted at the charging station of the apparatus. A pressure-operated switch is disposed in the motor circuit for shutting off the motor when the flask has been charged to the predetermined pressure.

Knopf, U.S. Pat. No. 3,868,978 discloses a rechargeable aerosol dispensing device which is recharged from a gas cartridge. The device consists of a container, a removable end plug, and a plunger valve in the end plug. The valve plunger can be attached either to a connecting socket for the gas cartridge, or a dispensing nozzle, so that the valve when pushed open, admits a charge of gas in the first case and dispenses the contents in the second case.

Becher, U.S. Pat. No. 2,906,300 discloses an apparatus for dispensing liquid consisting of a reservoir and a smaller container into which the liquid is drawn off from the larger reservoir. The reservoir contains a cylinder which performs the function of a piston pump. The cylinder has a first check valve, an upwardly spring biased piston, having a hole therethrough, and a second check valve in the hole. The piston has one nozzle communicating with the reservoir and an internal seat. The smaller container is provided with a connecting piece for filling and emptying corresponding to the shape of the nozzle. The smaller container can slide within the cylinder in the manner of a piston rod for filling the smaller container.

The prior art in general, and these patents in particular, do not disclose the present refillable pressure spray container having a filling and dispensing nozzle extending outwardly therefrom containing a valve member in combination with a quick disconnect coupling containing a valve actuating member, the coupling having one end adapted to be received on a pressure filling means and the opposing end adapted to sealably and releasably receive the extended end of said nozzle.

SUMMARY OF THE INVENTION

It is therefore one object of the present invention to provide a refillable pressure spray container which may be easily refilled and used repeatedly by the consumer.

Another object of this invention is to provide a refillable pressure spray container with a quick disconnect attachment to a filling apparatus.

Another object of this invention is to provide a refillable pressure spray container whereby the filling and dispensing nozzle contains a valve which is opened on insertion of the nozzle into a quick disconnect coupling.

Another object of this invention is to provide a refillable pressure spray container of rugged construction which is reliable in use, and easily operated.

Other objects of the invention will become apparent from time to time throughout the specification and claims as hereinafter related.

The above-noted objects and other objects of the invention are accomplished by a refillable pressure spray container having a filling and dispensing nozzle extending outwardly therefrom containing a valve member in combination with a quick disconnect coupling containing a valve actuating member, the coupling having one end adapted to be received on a pressure filling device and the opposing end adapted to sealably and releasably receive the extended end of said nozzle.

DESCRIPTION OF THE PREFERRED EMBODIMENT

Figure 1:
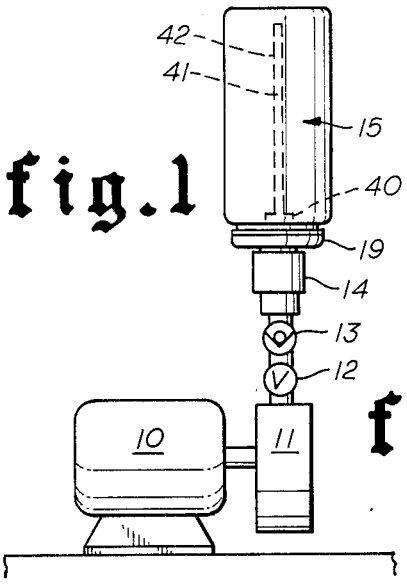
FIG. 1 is a schematic elevation of a refillable pressure spray container attached to a filling apparatus illustrating a preferred embodiment of the invention.
Figure 2:
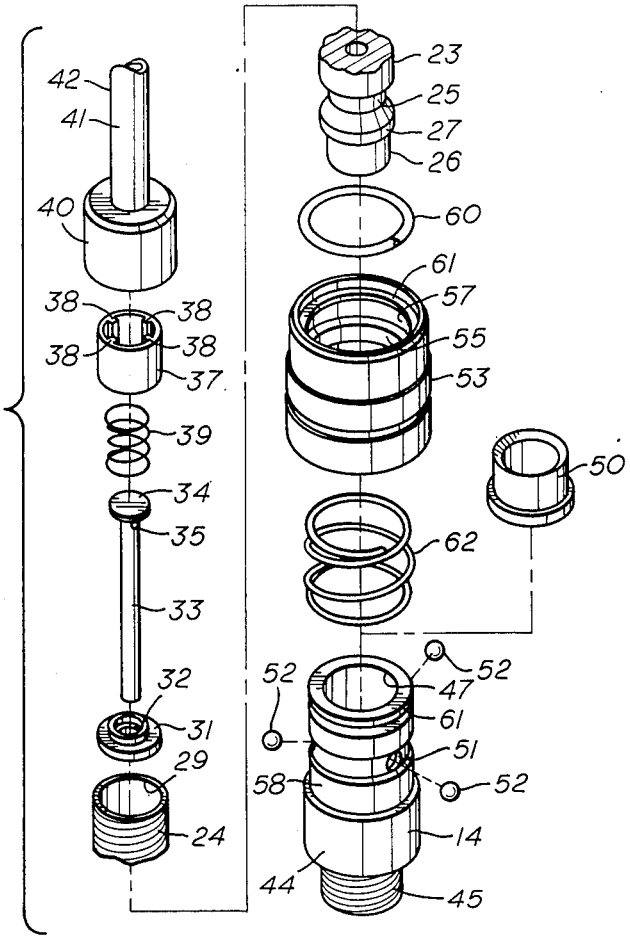
FIG. 2 is an exploded, isometric view of the components of the nozzle and quick disconnect coupling of the present invention.

Referring to the drawings by numerals of reference, and more particularly to FIG. 1, there is shown an electric motor 10 coupled to a pump or gas compressor 11. A conventional pressure relief valve 12 is provided at the outlet portion of the pump or gas compressor and a check valve 13 is connected in series therewith. A quick disconnect coupling 14 extends upwardly from the check valve 13 which receives a refillable pressure container 15 illustrating a preferred embodiment of the invention. Container 15 is shown inverted for the filling operation in all the drawing figures. FIG. 2 shows the components used in the dispensing valve and quick disconnect coupling in exploded relation.

Figure 3:
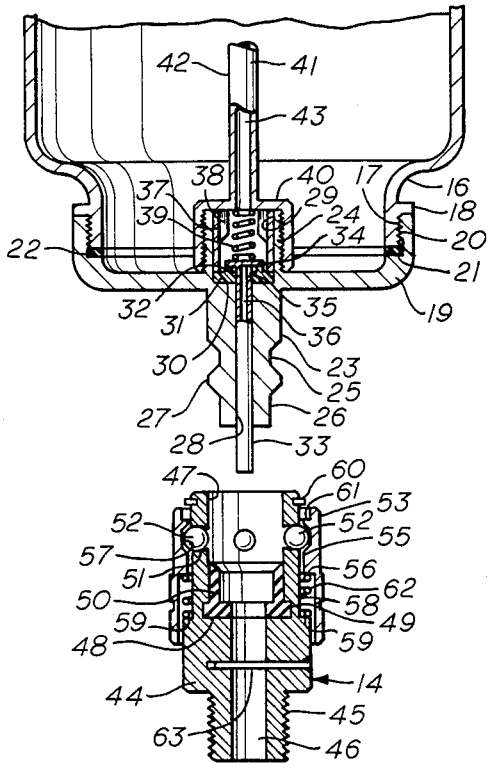
FIG. 3 is a view in central longitudinal cross section of the container before filling.

Referring to FIG. 3, the inverted neck portion 16 of the top end of the container 15 has exterior threads 17 extending from the end of the neck portion 16 to a circumferential outwardly extending flange 18. A generally cup-shaped cap member 19 has interior threads 20 extending from its end to a reduced internal diameter forming a flat horizontal shoulder 21. A sealing member or washer 22 is in sealing relation between the end of the neck portion 16 of the container and the shoulder 21 of the cap 19. A central cylindrical nozzle portion 23 extends outwardly from the cap 19 and a central, externally threaded extension 24 extends inwardly therefrom.

The outer surface of cylindrical nozzle 23 has a circumferential groove 25 and a reduced diameter portion 26 vertically spaced therefrom forming a circumferential shoulder 27 therebetween. A small central bore 28 extends longitudinally through the nipple portion 23 and a larger concentric counterbore 28 extends through the collar portion 24 to define a flat annular shoulder 30 therebetween.

The components of the dispensing valve shown in FIG. 2 are contained within the counterbore 29 and the bore 28. A flat resilient seal member 31 having a concentric upwardlly extending lip portion 32 is positioned on the flat annular shoulder 30. A hollow tubular plunger 33 enclosed at one end with a flange 34 is slidably received in the small bore 28 extending through the nozzle portion 23. The flange portion 34 of the plunger 33 abuts the upwardly extending lip 32 of the seal member 31. A small aperture 35 in the side wall of the plunger 33 communicates with the interior bore 36. Plunger 33 is sealed against leakage along its external surface by sliding, sealing contact with seal member 31.

A cylindrical sleeve member 37 in the counterbore 29 rests on the seal member 31 outside the circumferential lip portion 32. The sleeve member 37 has a series of radially opposed longitudinal ribs 38 which extend approximately midway along its interior surface. A small compression spring 39 is contained within the sleeve member 37 by the cap portion 40 of an elongated hollow stem member 41 which is threadedly secured on the threaded extension 24 of the cap 19.

In this manner, the spring 39 presses downwardly against the flange 34 of the plunger 33 to bias the plunger into a normally closed position against the lip 32 with the aperture 35 closed off by the seal 31. The elongated hollow tubular portion 42 of the stem 41 extends from the cap portion 19 to terminate near the bottom of the container 15. The central bore 43 of the tubular portion 42 communicates with the sleeve 37 through the spaces between the ribs 38. Communication is established between the stem 41 and the small bore of the plunger 33 when the flange 34 is raised from the lip 32 of the seal 31.

The quick disconnect coupling 14 is shown directly beneath the nozzle 23 in FIG. 3 representing the position before the filling operations. The quick disconnect coupling 14 comprises a central cylindrical body 44 having a threaded portion 45 at its lower end for attachment to the check valve 13 of the filling apparatus. A central bore 46 extends longitudinally through the cylindrical body 44. A counterbore 47 extends inwardly a distance from the top end forming a shoulder 48 adjacent to the bore 46. A groove 49 extends radially outwardly from the counterbore 47 to receive the lower flange portion of a cylindrical resilient seal 50. The reduced diameter portion 26 of the nozzle 23 is adapted to be received within the seal 50.

A series of horizontal inwardly tapered apertures 51 are provided in the upper portion of the side wall of the cylindrical member 44 and partially contain a series of ball members 52. The taper of the apertures is such that the ball members 52 will extend only partially inward into the counterbore 47. A cylindrical outer sleeve member 53 is slidably positioned on the cylindrical body 44. The interior lower portion of the sleeve 53 has a counterbore 54 and a concentric reduced diameter bore 55 defining a flat horizontal shoulder 56.

The cylindrical body 44 has a reduced diameter upper portion 58 defining a circumferential shoulder 59. The reduced diameter portion 55 of the sleeve 53 has an annular groove 57 adapted to receive the balls 51 in their outwardly extended position. The upper portion of the reduced diameter 58 of the cylindrical body 44 has a snap ring 60 and the top portion of the outer sleeve 53 has an annular shoulder 61 which is captured by the snap ring 59 when the sleeve 53 is in the upward position.

A compression spring 62 is positioned on the reduced diameter portion 58 of the cylindrical body 44 between the shoulder 59 of the cylindrical body and the shoulder 56 of the outer sleeve. The spring 62 urges the shoulder 61 of the outer sleeve member 53 normally upwardly against the snap ring 60 of the cylindrical body member 44 as shown in FIG. 4.

When the nozzle 23 of the container 15 is inserted into the quick disconnect coupling 14, the outer sleeve 53 must be pulled downwardly to allow the balls 51 to retract into the annular groove. A pin 63 extends horizontally through the cylindrical body 44 to act as a stop member for the plunger 33 raising it from the seal 50 as the nozzle 23 is inserted into the coupling. The pin 63 is secured in the cylindrical body by welding or brazing to prevent pressure loss through the pin connection.

Figure 4:
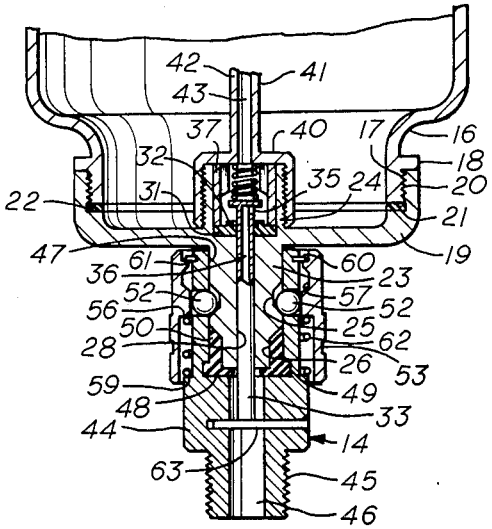
FIG. 4 is a view in longitudinal central cross section of the container in the filling position.
Figure 5:
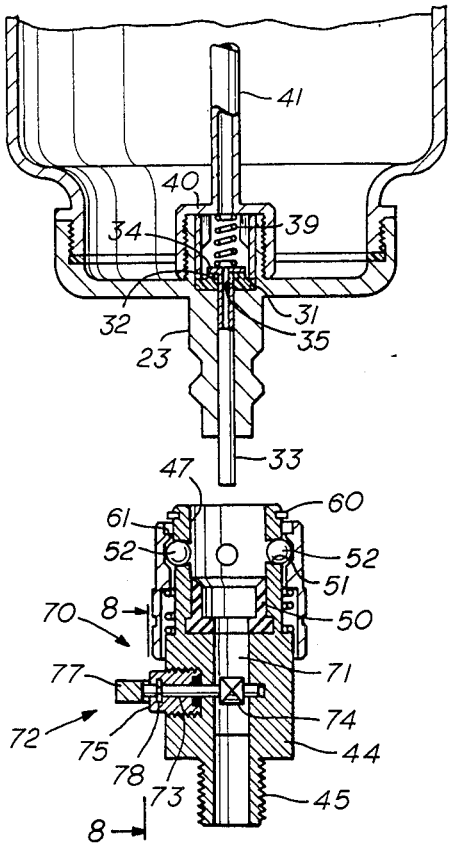
FIG. 5 is a view in central longitudinal cross section of the container and a modified quick disconnect coupling before filling.
Figure 6:
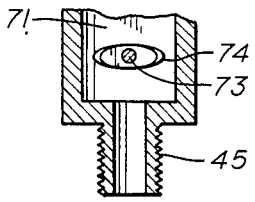
FIG. 6 is a sectional view of the shut-off portion of the disconnect valve shown in FIG. 5.

In FIG. 4 the container is shown with the nozzle portion 23 connected into the quick disconnect coupling 14 during the filling operation. The nozzle 23 is inserted into the counterbore 47 to extend downwardly thereinto and compress the cylindrical seal member 50 forming a pressure seal around the reduced diameter portion 26. The outer sleeve member 53 has been released to assume its normal upward position against the snap ring 60 forcing the balls 51 inwardly into the counterbore 47 and groove 25 of the nozzle member 23 to capture it therein. In this position, the flange 34 of the plunger is forced upward off the lip 32 of the seal 31 exposing the aperture 35 to allow communication between the quick disconnect coupling 14 and the interior of the container through the bore 36 of the plunger and the bore 43, tubular portion 42 of the elongated stem member 41.

In FIGS. 5, 6, 7, and 8, there is shown a modified quick disconnect coupling 70. The same reference numbers are used in the accompanying drawing figures for the same parts as previously described. In the embodiment depicted in these figures, an internal rectangular cavity 71 is provided in the upper portion of the cylindrical body 44. The pin member 63 is replaced by a petcock assembly 72 to unseat the plunger 33 from the lip 32 of the seal 31.

The petcock assembly 72 comprises a central shaft 73 which extends through one side of the lower portion of the cylindrical body 44 and partially into the opposing side wall. An oval shaped cam member 74 is secured on the shaft 73 for rotation therewith. A plug member 75 threadedly secured in the side wall rotatably receives the outwardly extended portion of the shaft 73. A sealing ring 76 is provided in the plug 75 to seal the shaft 73 against leakage therearound. A U-shaped retaining clip 78 is received in a slot 79 in the outer end of the plug 75. The legs of the clip 78 are received on a groove (FIG. 8) on the shaft 73 to secure the same against lateral movement.

A thumbscrew or handle 77 is provided on the outwardly extended end of the shaft 73 in longitudinal alignment with the longitudinal axis of the cam member 74. The bottom of the plunger 33 is urged downward by the spring 39 to ride on the outer surface of the cam member 74. The minor axis of the cam member 74 is such that when the handle 77 is turned horizontally, the plunger 33 will be biased downwardly by the spring 39 and the flange portion 34 thereof sealed on the lip 32 of the seal member 31.

Figure 7:
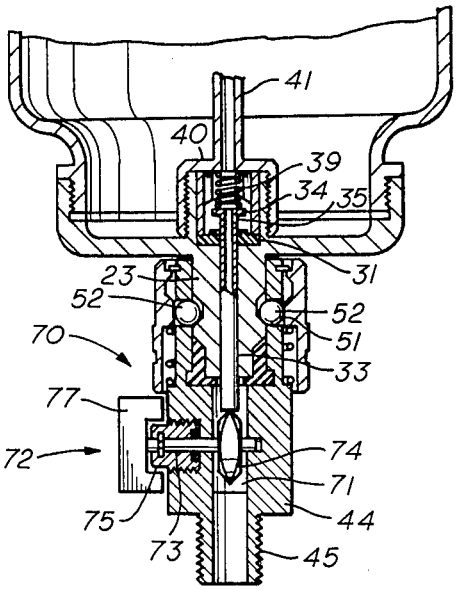
FIG. 7 is a view in longitudinal central cross section of the modified disconnect valve of FIG. 5 in the filling position.
Figure 8:
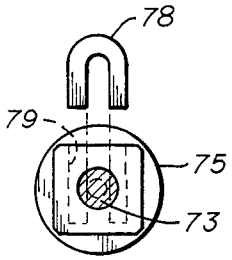
FIG. 8 is a sectional view taken on the line 8—8 of FIG. 5 taken through the modified quick disconnect coupling.

As shown in FIG. 7, when the handle 77 is turned vertically, the plunger 33 rides on the outer surface of the cam member 74 to raise the plunger upwardly lifting the flange portion 34 thereof from the lip 32 on the seal 31 to expose the aperture 35. In this manner, communication is established as previously described for the filling operation. In this position, handle 77 locks sleeve 53 against movement and prevents separation of the coupling.

Figure 9:
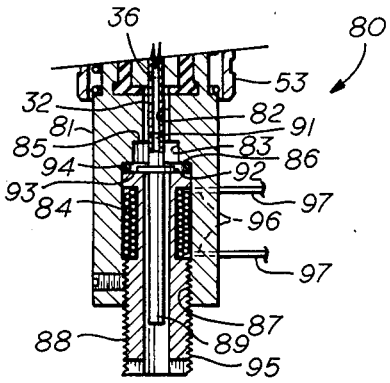
FIG. 9 is a view in longitudinal central section of an electrically operated quick disconnect coupling.

In FIG. 9, there is shown another modified quick disconnect coupling 80. The coupling 80 comprises a cylindrical body 81 having a small longitudinal bore 82, a concentric intermediate counter bore 83, and a concentric larger lower counterbore 84. An upper shoulder 85 is formed between the bore 82 and intermediate counterbore 83, and a lower shoulder 86 is formed between the intermediate counterbore 83 and the lower counterbore 84.

The bottom portion of the lower counterbore 86 is internally threaded as at 87. A hollow cylindrical electric solenoid 88 having external threads 95 is threadedly secured in the lower counterbore 84. The lower end of a hollow tubular plunger 89 is positioned for sliding movement vertically in the solenoid 88. A set screw 90 secures the solenoid 88 within the cylindrical body 81. The lower threaded portion of the solenoid extends outward from the bottom of the body to be received within the valve 13.

The upper portion of the plunger 89 is the same diameter as the lower portion of the plunger 33 and has a central longitudinal bore 91 corresponding to the bore 36 of plunger 33. Plunger 89 has a circumferential flange 92 resting on the top surface 93 of the solenoid 88. A sealing ring 94 between the top surface 93 and the shoulder 86 seals against pressure leakage around the solenoid 88. Conductors 96 in the body 81 connect the coil of the solenoid 88 to a source of electrical current (not shown) by leads 97.

With the nozzle inserted into the coupling 80 in the manner previously described, the solenoid 88 may be activated to force the plunger 89 upward to contact the lower portion of the plunger 33 and expose the aperture 35 to establish the path of communication as previously described in the other embodiments. Deactivating the solenoid allows the plungers to move down under spring pressure to seal the contents within the container.

OPERATION

Referring to FIGS. 1, 3, and 4, the quick disconnect coupling is attached to the relief valve of the pump. The container is inverted as shown in the figures and the nozzle portion is inserted into the quick disconnect coupling as shown in FIG. 4. In this position the plunger member is raised exposing the aperture to establish communication between the pump or gas compressor, the relief valve, the quick disconnect coupling, the plunger bore, and through the elongated stem into the interior of the container. The electric motor is energized to drive the pump or gas compressor to force air, or gas under pressure through the path of communication as previously described to pressurize the container. When the pressure in the container reaches a predetermined level, the relief valve opens to the atmosphere. After the pump has been turned off, the outer sleeve of the quick disconnect coupling is pulled down and the container is removed therefrom.

When the container is removed from the quick disconnect coupling, the plunger returns to its seated position against the lip on the seal and the aperture is closed off thereby safely containing the pressurized liquid in the container. The container is then inverted with the nozzle portion extended upwardly and a conventional aerosol spray nozzle may be inserted onto the end of the plunger. The container is now ready to be used as a conventional aerosol hand-held container. When the contents of the container are depleted, the conventional spray nozzle may be removed and the container can be inverted and inserted in the quick disconnect coupling for another refilling operation.

It should be understood that to establish communication for the filling operation in the embodiment of FIG. 7, handle 77 is turned vertically to raise the plunger 33, and in the embodiment of FIG. 9, the plunger is raised by operation of the solenoid 88.

While this invention has been described fully and completely with special emphasis on a preferred embodiment, it should be understood that within the scope of the appended claims the invention may be practiced otherwise than as specifically described herein.

I claim:

1. A refillable pressure spray system comprising, in combination a motor driven gas compressor having a gas inlet and an outlet for compressed gas, a quick disconnect coupling having first and second separable parts having a spring-loaded sleeve and ball detents for quick assembly and disassembly, said first quick disconnect coupling part being rigidly secured in a fixed position on said compressor outlet and extending vertically upward therefrom, a refillable pressurizable container removably secured on and communicating with said compressor outlet comprising a pressure-resistant container having one open end, a removable cap closing and sealing said open end, a filling and dispensing nozzle extending outwardly from said cap, a hollow tubular stem extending inwardly from said cap into said container to a point near the bottom and of said container, said second quick disconnect coupling part comprising part of said nozzle and fitting said first quick disconnect nozzle part to form a passage from said compressor to the interior of said container for pressurizing the same and supporting said container in an inverted position, and valve means, supported in a fixed position on said compressor outlet and in said quick disconnect coupling adapted to be open when said quick disconnect coupling is in a connected position for flow of compressed gas through said coupling into said container and adapted to be closed on separation of said quick disconnect coupling parts, said container being removable by separation of said quick disconnect coupling by operation of said spring-loaded sleeve, after filling, for use in spraying.

2. A refillable pressure spray system according to claim 1 in which said valve means comprises a valve member positioned in said nozzle, and means associated with said quick disconnect coupling to cause said valve member to be open when said quick disconnect coupling is in a connected relation.

3. A refillable pressure spray system according to claim 2 in which said valve member comprises a hollow tubular plunger slidably movable in said hollow tubular stem and having a valve opening movable to an open position by longitudinal movement thereof, and said means for causing said valve member to be open comprising means to move said plunger longitudinally of said nozzle while said quick disconnect coupling is in a connected relation.

4. A refillable pressure spray system according to claim 2 in which said valve member comprises a hollow tubular plunger slidably movable in said hollow tubular stem and having a valve opening movable to an open position by longitudinal movement thereof, and said valve member having moving means comprising means to move said plunger longitudinally of said nozzle during the connection of said quick disconnect coupling.

5. A refillable pressure spray system according to claim 2 in which said valve member comprises a hollow tubular plunger slidably movable in said hollow tubular stem and having a valve opening movable to an open position by longitudinal movement thereof, and said valve member having moving means comprising means to move said plunger longitudinally of said nozzle after said quick disconnect coupling has been connected.

6. A refillable pressure spray system according to claim 4 in which said valve member moving means comprises a pin extending laterally through said first quick disconnect coupling part.

7. A refillable pressure spray system according to claim 5 in which said valve member moving means comprises a shaft rotatably positioned laterally through said first quick disconnect coupling part and having an outwardly extended end, a cam member secured to said shaft for rotation therewith, the outer surface of said cam member actuating said valve on rotation, means for sealing the outwardly extended end of said shaft, and a handle secured on the outwardly extended end of said shaft for rotating said shaft.

8. A refillable pressure spray system according to claim 5 in which said valve member moving means comprises an electrically operated solenoid operatively positioned in the said first part of said quick disconnect coupling and having a movable element engagable with said tubular plunger on energization.

9. A refillable pressure spray system according to claim 2 in which said valve means comprises;

a resilient seal member positioned in said nozzle, a hollow tubular plunger extending slidably through said seal member into said container, said plunger being closed at one end and having an external flange and having the opposite end open and protruding outwardly from said nozzle, said tubular plunger having an aperture in its side wall adjacent to said flange, said plunger having one position with said flange and aperture positioned in sealing relation to said seal member and closing said aperture, said flange and aperture being movable longitudinally from said seal member to establish communication through said aperture between the interior of said container through said hollow tubular stem and said plunger, and a spring member between the top of said plunger flange and said stem biasing said plunger toward a closed position.

10. A refillable pressure spray system according to claim 9 in which said seal member comprises a flat resilient seal member having a concentric upwardly extending lip portion for sealably engaging said flange.

11. A refillable pressure spray system according to claim 1 in which said first part of said quick disconnect coupling comprises a cylindrical body having a threaded portion at one end secured on said compressor outlet and having a central longitudinal bore receiving said nozzle, a resilient seal member disposed within said cylindrical body sealing the end of said nozzle, a series of circumferentially spaced horizontal inwardly tapered apertures in the upper portion of the side wall of said cylindrical member, said ball detents being movably supported in said apertures, said ball detents being radially movable to function as detents, said spring-loaded sleeve being slidably mounted and biased for vertical movement on said cylindrical body for moving said ball detents, and valve actuating means disposed within said coupling for moving said valve means within said nozzle from closed position to open position.

12. A combination according to claim 11 in which said valve actuating means comprises a pin extending laterally through said central bore.

13. A combination according to claim 11 in which said valve actuating means comprises;

a shaft rotatably disposed horizontally through the central bore of said cylindrical body and having one end extending outwardly therefrom, a cam member secured to said shaft for rotation therewith within said central bore, sealing means on said cylindrical body sealing said outwardly extended end of said shaft, and a handle on the outwardly extended end of said shaft for rotating said shaft.

14. A combination according to claim 11 in which said valve actuating means comprises;

an electrically operated solenoid operatively positioned in the central bore of said cylindrical body and having an operating pllunger movable on energization of said solenoid.

15. A refillable pressurizable container for use in a pressure spray system having a motor driven gas compressor with a gas inlet and an outlet for compressed gas, a quick disconnect coupling having first and second separable parts having a spring-loaded sleeve and ball detents for quick assembly and disassembly , said first quick disconnect coupling part being rigidly secured in a fixed position on said compressor outlet and extending vertically upward therefrom, including valve means, supported in a fixed position on said compressor outlet and in said quick disconnect coupling adapted to be open when said quick disconnect coupling is in a connected position for flow of compressed gas through said coupling into said container and adapted to be closed on separation of said quick disconnect coupling parts, said pressurizable container comprising a refillable pressurizable container adapted to be removably secured on and communicating with said compressor outlet in an inverted position comprising a pressure-resistant container having one open end, a removable cap closing and sealing said open end, a filling and dispensing nozzle extending outwardly from said cap, and a hollow tubular stem extending inwardly from said cap into said container to a point near the bottom end of said container, said pressurizable container further comprising said second quick disconnect coupling part, said second quick disconnect coupling part comprising part of said nozzle and fitting said first quick disconnect nozzle part to form a passage from said compressor to the interior of said container for pressurizing the same, and valve means adapted to be open when said quick disconnect coupling is in a connected position for flow of compressed gas through said coupling into said container and adapted to be closed on separation of said quick disconnect coupling parts, said container being adapted to be removed by separation of said quick disconnect coupling by operation of said spring-loaded sleeve, after filling, for use in spraying.

16. A refillable pressurizable container according to claim 15 in which said valve means comprises a valve member positioned in said nozzle, and said quick disconnect coupling including means to cause said valve member to be open when said quick disconnect coupling is in a connected relation.

17. A refillable pressurizable container according to claim 16 in which said valve member comprises a hollow tubular plunger slidably movable in said hollow tubular stem and having a valve opening movable to an open position by longitudinal movement thereof, and said means for causing said valve member to be open comprising means to move said plunger longitudinally of said nozzle while said quick disconnect coupling is in a connected relation.

18. A refillable pressurizable container according to claim 16 in which said valve member comprises a hollow tubular plunger slidably movable in said hollow tubular stem and having a valve opening movable to an open position by longitudinal movement thereof, and said means for causing said valve member to be open comprising means to move said plunger longitudinally of said nozzle during the connection of said quick disconnect coupling.

19. A refillable pressurizable container according to claim 16 in which said valve means comprises;

a resilient seal member positioned in said nozzle, a hollow tubular plunger extending slidably through said seal member into said container, said plunger being closed at one end and having an external flange and having the opposite end open and protruding outwardly from said nozzle, said tubular plunger having an aperture in its side wall adjacent to said flange, said plunger having one position with said flange and aperture positioned in sealing relation to said seal member and closing said aperture, said flange and aperture being movable longitudinally from said seal member to establish communication through said aperture between the interior of said container through said hollow tubular stem and said plunger, and a spring member between said plunger flange and said stem biasing said plunger toward a closed position.

20. A refillable pressurizable container according to claim 19 in which said seal member comprises a flat resilient seal member having a concentric upwardly extending lip portion for sealably engaging said flange.

* * * * *